United States Patent [19]

Keglewitsch et al.

[11] Patent Number: 4,500,162

[45] Date of Patent: Feb. 19, 1985

[54] CONTACT CLIP APPARATUS FOR BLADE-TYPE CONTACTS

[75] Inventors: Josef Keglewitsch; Theodore J. Stechschulte, both of Bowling Green, Ohio

[73] Assignee: Marathon Electric Manufacturing Corporation, Wausau, Wis.

[21] Appl. No.: 367,454

[22] Filed: Apr. 12, 1982

[51] Int. Cl.[3] ..... H01R 11/22

[52] U.S. Cl. ..... 339/252 F; 339/256 C; 339/258 F; 339/259 F

[58] Field of Search ..... 339/259 F, 252 F, 253 F, 339/258 R, 256 SP, 97 P, 256 C

[56] References Cited

U.S. PATENT DOCUMENTS

| | | | |
|---|---|---|---|
| 1,938,097 | 12/1933 | Curlee | 339/262 F |
| 2,709,793 | 5/1955 | Johansson | 339/258 F X |
| 2,709,794 | 5/1955 | Johansson | 339/258 F |
| 2,746,024 | 5/1956 | Ostrak | 339/256 SP |
| 3,117,829 | 1/1964 | Leach | 339/97 P |
| 3,283,289 | 11/1966 | Cobaugh | 339/97 R |
| 3,383,645 | 5/1968 | Milanese et al. | 339/258 R |

FOREIGN PATENT DOCUMENTS

| | | | |
|---|---|---|---|
| 610463 | 10/1948 | United Kingdom | 339/262 F |
| 620541 | 3/1949 | United Kingdom | 339/258 R |

*Primary Examiner*—William R. Briggs

*Attorney, Agent, or Firm*—Andrus, Sceales, Starke & Sawall

[57] ABSTRACT

A fuse clip apparatus is disclosed which provides connecting means for a blade type cartridge fuse in a circuit. The fuse clip includes an extruded terminal connector formed of aluminum or copper. The connector includes a terminal block for connection to an electrical lead. A blade contact portion is generally channel-shaped and includes a flat contact wall on one side of the extruded block and a spaced integral spring support wall. A beam plate spring is integrally formed with, or separately formed and interconnected to, the support wall. The illustrated spring is a double supported convex beam which extends from spaced support portions of the support wall toward the flat contact wall. The blade of the fuse is forced between the convex beam spring and the contact wall to hold the blade in firm engagement with the contact wall.

14 Claims, 6 Drawing Figures

CONTACT CLIP APPARATUS FOR BLADE-TYPE CONTACTS

BACKGROUND OF THE PRESENT INVENTION

This invention relates to an improved contact ciip and particularly a fuse clip for releasable connection of a contact blade of a blade-type cartridge fuse into a circuit.

Fuse clips are widely used for interconnecting of fuses into electrical circuits. The blade-type cartridge fuses are particularly used in power circuits or the like. The fuse includes a cartridge body with connecting contact blades to the opposite ends of the body. The fuse blade provides a large extended contact surface for current transfer to the connected circuit. Generally, blade-type fuse clips have included a pair of opposing spring contact members which resiliently grasps the opposite surfaces of the fuse blade. More recently, single surface terminal blocks have been suggested having a flat wall against which the fuse blade is resiliently held by a spring member. For example, U.S. Pat. No. 4,059,334, which issued Nov. 22, 1977 to William R. Bailey, discloses a blade-type fuse clip assembly including an extruded terminal block in combination with a nonconductive L-shaped cantilevered spring member for urging of the fuse blade into abutting engagement with a flat contact wall. The resilient member, although formed of an inexpensive dielectric material, is generally formed with a configuration having an outer outturned lip which cooperates with a corresponding end on the contact to define a V-shaped blade entrance for receiving of the contact blade. The blade is forced downwardly between the contact and the resilient member which deflects outwardly. Thus, the clip action of the extruded block connector essentially corresponds to that which has heretofore been employed in connection with the two-spring arm fuse clip devices.

Although the various fuse clip devices have found wide application and usage in the industry, a relatively large insertion force is normally encountered in order to produce the desired holding force. Relatively complex designs have been used in connection with the fuse clip assemblies employing a substantial number of different components. Prior art devices have also generally not been conducive to small, compact construction while maintaining the necessary electrical characteristic, and in many instances have been relatively costly to construct. Similar considerations also apply in other electrical switching fields, such as blade type disconnect switches.

SUMMARY OF THE PRESENT INVENTION

The present invention is particularly directed to a contact apparatus particularly adapted to blade-type contacts and has been particularly applied to blade-type fuses. Generally in accordance with the present invention, a contact clip apparatus includes an integrated terminal block including a flat contact wall and an opposed beam spring member. The beam spring member is interconnected to a support wall, either integrally or through a separate interconnection. The beam spring member is formed with a curved configuration with a central bearing portion located to engage the fuse blade and resiliently hold the blade in engagement with the contact wall. The curved beam spring with the contact wall is constructed and arranged to define an improved tapered entrance for receiving of the contact blade with a relatively small insertion force. In a preferred and unique embodiment of the present invention the spring member thus defines a relatively shallow angle of entrance to the blade; generally on the order of 30 degrees or less, which minimizes the insertion force while maintaining the desired holding normal force. A more conventional fuse clip has an angle of entrance between the blade and the spring members on the order of 45 degrees. The difference in insertion force between the beam spring and the conventional clip spring is at a ratio of about 4 to 1. The particular holding normal force can easily be adjusted by varying the thickness or the tensile strength of the spring material and thereby obtain a large range of properties.

In a preferred and optimum construction, the terminal connector block is produced from an aluminum or copper extrusion having a heavy solid terminal block with appropriate lead connecting means. A contact wall projects upwardly from the block, and in laterally spaced relation, a second integral spring support wall. In a one piece construction, a compression beam spring member is integrally formed with the spring support wall. In this embodiment the spring member is preferably formed with top and bottom fingers or members with a short gap between the top and bottom members at the blade engaging end location. The top member primarily aligns the blade against the contact surface and establishes the desired holding pressure while the bottom member ensures full length contact of the fuse blade with the contact wall. In the two piece construction, the spring is formed separate from the support as a convex beam spring, the opposite ends of which are attached to the spring support member.

The convex beam spring with proper angle of convexity again provides a highly desirable low insertion force while simultaneously establishing an appropriate normal holding force. The spring member can be formed of a conductive or nonconductive material as the primary current transfer occurs directly between the fuse blade and the abutting planar or flat contact wall.

The simplicity of the apparatus, with the reduction in component parts not only reduces the cost but contributes to a simplified manufacturing technique for a contact structure, which has particularly provided an improved fuse clip apparatus having a high degree of integrity, quality, performance and fatigue strength.

DESCRIPTION OF THE DRAWING FIGURES

The drawing furnished herewith illustrates a preferred construction of the present invention in which the above advantages and features are clearly disclosed as well as others which will be readily understood from the following description.

In the drawing

BRIEF DESCRIPTION OF THE ILLUSTRATED EMBODIMENT

Figure 1:
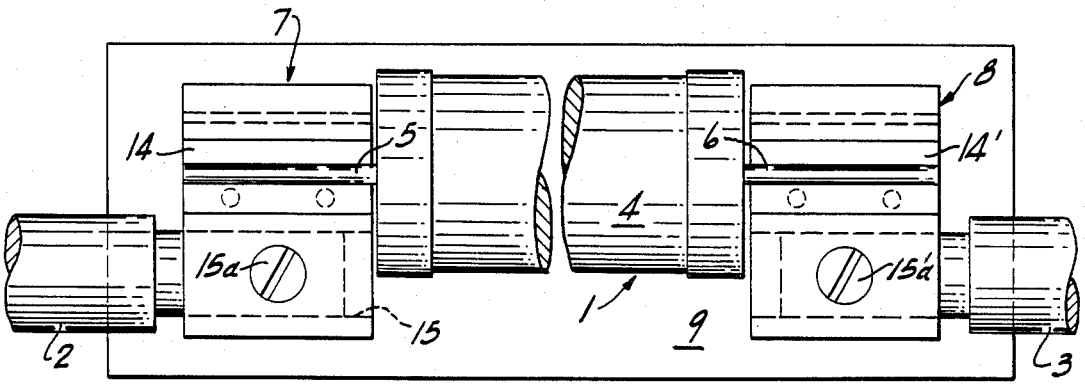
FIG. 1 is a plan view of a fuse clip assembly with a blade-type cartridge fuse mounted therein.

Referring to the drawings and particularly to FIG. 1, the present invention is shown in connection with a fused electrical circuit assembly including a blade-type cartridge fuse 1 forming a fuse connection between first and second electrical cables 2 and 3. The blade-type cartridge fuse includes a central cartridge 4 within which a fuse element, not shown, is secured extending longitudinally throughout the cartridge. Contact blades 5 and 6 are secured to each end of the cartridge 4 and connected in any well known manner to the internal fuse. The blades 5 and 6 in accordance with well known construction are flat plate-like members formed of a highly conductive material, such as copper or aluminum. The fuse 1 is thus connected at the opposite ends to the respective cables 2 and 3 by similar fuse clips 7 and 8, which are constructed in accordance with the teaching of the present invention, and which firmly grasp the end blades 5 and 6, respectively. Each clip 7 and 8 is similarly constructed and are shown secured to an insulating base panel 9. The fuse clips 7 and 8 are spaced appropriately to receive the end blades with the fuse cartridge located therebetween. In the presence of abnormal current condition, the fuse will burn open. The fuse 1 is made replaceable for substitution of a new fuse after correction of the circuit conditions. The present invention is particularly directed to the provision of an approved fuse clip for firmly and reliably holding of the fuse while establishing firm and reliable circuit connection to the fuse blades.

The fuse clip 7 is illustrated in detail in FIGS. 2–5 and is described. The clip 8 has corresponding elements identified by prime numbers and a separate description thereof is not given.

Figure 2:
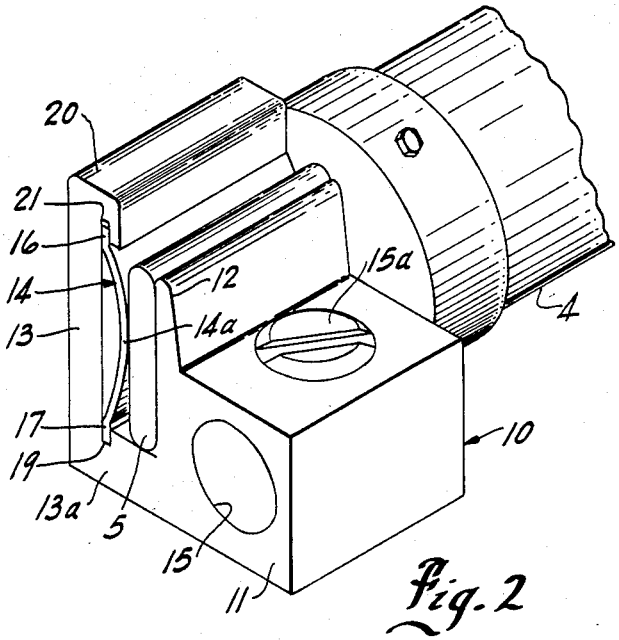
FIG. 2 is an enlarged perspective view of one end of the fuse clip apparatus illustrated in FIG. 1.
Figure 3:
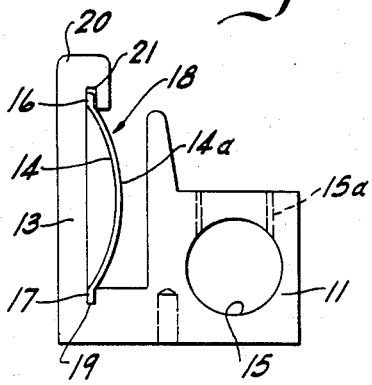
FIG. 3 is an end view of the fuse clip apparatus shown in FIGS. 1 and 2 with the fuse removed.

The fuse clip 7 includes a terminal connector 10 including a substantially rectangular lead connecting block 11 and an upstanding contact wall 12 projecting upwardly along one wall thereof. The contact wall 12 is integrally formed with the connecting block 11. A spring support wall 13 extends parallel to the contact wall 12 from the lower or bottom portion of the block 11. The spring support wall 13 is connected to the terminal block 11 by a connecting base **13*a* and with wall 12 defines a blade receiving channel or slot. In accordance with the present invention, a beam spring 14 is located within the channel and interconnected to the support wall 13. The spring member 14 is a convex unit which is secured at the opposite ends to the wall 13 and extends laterally from the wall 13 to form a reduced blade receiving opening adjacent to the contact wall 12. The fuse blade 5 has a thickness significantly more than the gap between the contact wall 12 and the outermost point 14*a* of the beam spring 14, as shown in FIGS. 2 and 3. The blade 5 is forced downwardly between the contact wall 12 and the spring member 14 to insert the fuse 1. The spring member 14 serves to force the blade 5 laterally into engagement with the flat contact wall 12, and thereby establishes an electrical interconnection of the fuse blade 5 to the terminal block 11. The block 11 in turn functions as a terminal connection to receive the electrical lead 2** which is suitably secured within the terminal block.

More particularly, the terminal block 11 is of a substantially square cross-section with flat side walls. The terminal block 11, the contact wall 12 and support wall 13 is preferably formed an an integral, single-piece extruded member of copper or aluminum in accordance with well known construction. The illustrated block is of the lead pass-through-type and includes a lead receiving opening 15 to receive the stripped end of lead 2. A clamping screw **15*a* threads downwardly through a correspondingly threaded opening in the top wall of the block 11 and is operative to clamp the lead 2** firmly within the opening.

The contact wall 12 projects upwardly as a continuation of the inner wall of the terminal block 11 in the form of a plate-like member to define a flat contact wall surface. In the assembled relation, the fuse blade 5 engages the contact wall 12 including the continuous wall of the terminal block 11 to form an extended current transfer interface.

The contact wall 12 and the fuse blade 5 are formed as smooth finished surfaces to provide firm and reliable current interchange with the blade 5 held in firm positive engagement therewith. As shown most clearly in FIGS. 2 and 3, the beam spring 14 is formed as a convex plate spring member having outer support or connecting edges shown as flat or planar connecting ends 16 and 17 integrally formed at the opposite edges of the spring. The spring 14 has a width substantially equal to the length of the blade to form a spring loading over the length of the blade and contact wall. The flat ends 16–17 of the spring 14 are secured to the support wall 13 to locate the outer convex portion generally centrally of the contact wall 12 and the blade 5. The outermost portion is shown spaced from the contact wall in the unstressed state by a distance less than the thickness of the fuse blade 5, in FIG. 3. The curved portion of the spring with the adjacent flat contact wall 12 defines a notched tapered entrance portion 18 including a flat vertical wall and a curved spring wall. The contact blade 5 moves downwardly into the tapered opening, and with appropriate force, causes deflection of the beam spring 14 to permit forced entry of the fuse blade 5 between the spring 14 and the flat contact wall 12. In the assembled relation, the blade 5 abutts the base **13*a* of the channel, with the contact face in abutting relation to the contact wall. The spring 14 is located and constructed such that the outermost convex portion 14*a* engages the central portion of the contact blade. The deflection of the spring 14 creates a spring force holding the fuse blade 5 in firm and uniform pressurized engagement with the contact wall. The faces of the blade 5 and the contact wall 12 are finished surfaces to establish a highly conductive interface for transfer of current between the blade and the contact wall with minimal and insignificant resistance. The double beam spring member provides a significantly improved holding of the contact blade 5 in engagement with wall 12** while requiring minimal introduction forces.

In the illustrated embodiment of the invention, the separate spring member 14 is secured at the opposite end edges to the support wall by simple slot and projection type interconnections. The base **13*a* of the channel opening is provided with a slot 19 adjacent the support wall complementing and receiving the flat end 17 of the spring 14. The outer end of the spring support wall 13 is formed to a projection wall 20 having a recess or slot 21 formed immediately adjacent to the contact wall. The upper flat end 16 of the spring 14 is located in the upper slot 21, which is slightly deeper than flat end 16 to allow slight movement of the spring during the insertion. The spring member 14 can of course be deflected for convenient insertion. Alternately, the spring member 14 can be forced into the slots 19 and 21 from the outer end and firmly secured in position through its own resiliency. The slotted connection provides a simple but reliable means of interconnecting of the beam spring to the extruded contact block member. The spring member 14** can be formed of any suitable material, such as a spring steel, a non-conductive plastic or the like because the spring functions primarily to establish and maintain firm interengagement of the members at the current interface.

Figure 4:
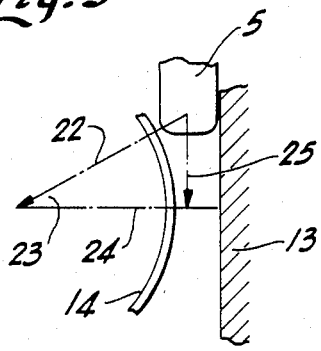
FIG. 4 is a diagrammatic view of the fuse clip apparatus illustrating the insertion and holding forces.

During the blade insertion the blade is moved downwardly into the gap 18 defined between the flat contact wall 12 and the uppered curved portion of spring member 14, as shown in FIG. 4. The blade 5 moves downwardly causing deflection of the spring member 14. The flat wall with the curved beam spring defines the generally V-shaped insertion for receiving the edge of the fuse blade 5. The fuse blade 5 deflects the spring outwardly in response to application of the necessary insertion force. This permits convenient and ready insertion of the fuse blade 5 into complete interengagement with the contact wall 12.

Referring particularly to FIG. 4, the curved spring 14 defines an angle of force insertion, as shown by line 22, which has a relatively small horizontal insertion angle 23, taken between the blade force line and a horizontal line of force. Thus, the insertion force line 22 is determined by the curvature of the beam spring 14. This angle 23 is selected by proper beam geometry such that the opposing spring force acting on the blade 5 during the initial insertion defines a relatively shallow angle to the horizontal. Generally, the angle in a commercial design has been on the order of 45 degrees. The total force includes a vertical force component 25 and the horizontal working force component 24, which are defined by well known geometry. The horizontal force, as shown by line 24, must provide a selected minimum holding force acting on the abutting face of the blade 5. A typical holding force specification is fifty pounds. To attain the preset holding force, the total insertion force is defined by the algebraic sum thereof and the vertical force, shown by line 25. For a given holding force and given angle, the total force is readily determined. Assuming normal holding force is fifty pounds, the vertical force will be on the order of twenty-nine pounds and a total insertion force of twenty-nine pounds. A conventional fuse clip is constructed with an angle of approximately 45 degrees. In such a conventional fuse clip, the vertical insertion force and the normal holding force are equal, and for a fifty (50) pound holding force requires a total insertion force of one hundred pounds.

Further, in the present invention, the blade alignment is established by the flat contact wall of the terminal connector block. The beam spring member need only provide sufficient pressure to properly hold the fuse blade in abutting engagement with the contact wall.

The double supported beam spring 14 of the present invention creates, with a minimal deflection, the necessary holdig force to firmly and positively hold the fuse blade in proper alignment and engagement with the contact wall. For example, the double supported beam, as shown in FIGS. 1-3, when compared to a conventional cantilivered beam, exhibits a holding force within the normal elastic range used for high amperage fuse clips in a ratio of approximately 4 to 1. The thickness of the beam spring and/or its tensile strength can be readily selected to produce a given characteristic or property as required by a particular application.

The extruded connector 10 with the integral contact and support walls can be formed to accommodate different types of circuit connection requirements. The embodiment of FIGS. 1-3 illustrate a standard pass through version having the lead attachment opening and clamping screw. The extrusion may be readily formed for other forms of connection such as a stud connector, a combined stud and feed-through connector, a dual or distribution feed-through connector, a combination fuse and disconnect with a common surface 12 or the like.

The system is particularly unique in providing a highly effective normal holding force while, in the preferred construction, establishing a low fuse blade insertion force as a result of the improved spring geometry associated with the beam spring.

Figure 5:
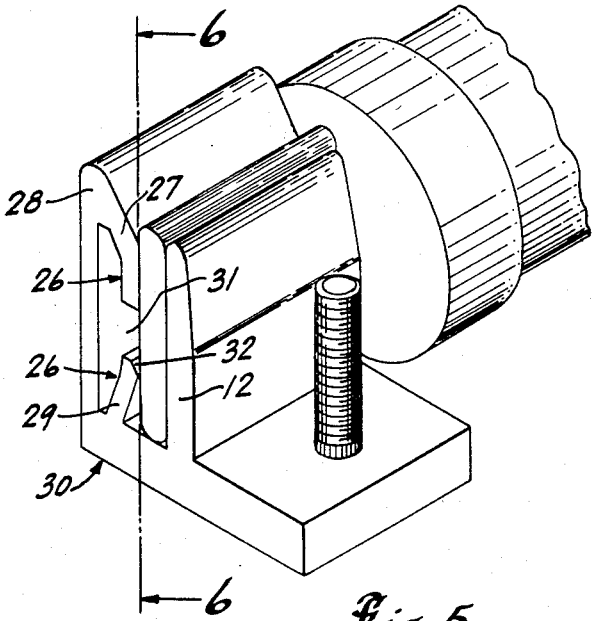
FIG. 5 is a view similar to FIG. 2 illustrating an alternate embodiment of the invention.
Figure 6:
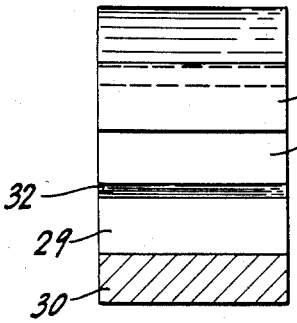
FIG. 6 is a vertical section view taken through the clip generally on line 6—6 of FIG. 5.

Although shown in one preferred construction in FIGS. 1-4, the clip can also advantageously be formed as a one piece unit with an integral beam spring, such as shown in FIGS. 5 and 6. Corresponding elements in the two embodiments are identified by the same number and only the changes are described.

The embodiment of the invention shown in FIG. 5 includes a spring member 26 which is formed as an integral member with the support wall 13. The spring member 26 is again formed as a curved beam-like unit having a width generally corresponding to the length of the blade. In the integral structure shown, the spring member 26 includes a top spring finger 27 integrally extruded to upper edge of the support wall as at 28 and a bottom spring member 29 integrally extruded to the bottom edge of the support wall as at 30. The spring members 27 and 29 have a predetermined corresponding curvature and are flexible relative to the connections to the support wall 13. The top and bottom members curve inwardly and terminate in slightly spaced relation to each other to form a gap 31 therebetween.

The top spring finger 27 thus is shaped to essentially correspond to the one piece spring of the first embodiment. Thus, the curved spring finger 27 may define a corresponding low insertion force requirement.

In the second embodiment of the invention, the top spring finger 27 is constructed and designed to provide the primary alignment of the blade 5 as well as providing the necessary and desired holding force on the blade to create the firm engagement with the contact wall 12. The lower spring finger 29 assures full length contact of the blade 5 throughout the aligned surface of contact wall 12 to maximize the current transfer area. The outer edge of the spring finger 29 is chamfered as at 32, throughout the total spring width as shown in FIG. 6, to define an entrance gap for the blade 5 as it moves into the area of the lower or inner finger 29. The beam geometry of the spring fingers 27 and 29 are selected to create the necessary holding force resulting from the small deflection created by the insertion of the blade 5.

In the illustrated embodiment, the compression beam spring is shown with the curvature in the plane of the blade. Within the broadest aspect of the invention, the beam spring may be otherwise oriented; for example, at ninety degrees to the illustrated orientation or even to some intermediate angular orientation. Further, the beam spring may even be formed with a substantially spherical configuration so as to establish a spherical pressure point on the contact blade. The spring is suitably supported at the proper edges to produce the desired spring action. The present invention thus provides a simple, reliable and improved blade-type contact arrangement and has particularly been applied in a fuse clip having a significant improvement in the spring characteristic provided by the beam type spring, with a minimal fuse insertion force. The single piece and the two piece designs both include a short current path between the fuse and the circuit leads as a result of the one full side contact of the fuse block. The minimum components required by the new fuse clip in both the two piece and the single piece designs results in improvement in the integrity, the quality and the fatigue strength associated with the fuse clip apparatus. The contact design is of course universally applicable to all blade-type fuse assemblies as well as other blade-type switching devices and may be relatively small and compact in design.

Various modes in carrying out the invention are contemplated as being within the scope of the following claims, particularly pointing out and distinctly claiming the subject matter which is regarded as the invention.

We claim:

1. A fuse clip apparatus for receiving a flat fuse blade comprising an extruded conductive member including a lead terminal connector, an open channel member integrally connected to said terminal connector and including a planar wall defining a blade-engaging contact surface having an extent and configuration substantially corresponding to that of the fuse blade and being engaged by the fuse blade in the operative state and a second support wall spaced from said contact surface, and a curved beam spring secured by means at the opposite ends to said support wall within said channel and curving inwardly from the opposite ends of said support wall and forming a curved spring means spanning the contact surface with the outermost curved portion located generally centrally of the blade-engaging contact surface, said outermost curved portion being spaced from the contact surface by a distance significantly less than the thickness of the fuse blade and establishing a horizontal deflection force in excess of the vertical insertion force whereby a fuse blade of a blade type fuse positioned between said contact surface deflects said beam spring and said beam spring functions to maintain said fuse blade in full surface contact with said contact surface.

2. The fuse clip of claim 1 wherein said spring is integrally formed with said support wall.

3. The fuse clip of claim 2 wherein said spring includes a pair of oppositely located spring fingers extending from the opposite ends of the support wall, said fingers being correspondingly configured with the opposed ends spaced from each other.

4. The fuse clip of claim 1 or 2 wherein said spring and said contact wall locate the fuse blade with an insertion angle substantially less than forty-five degrees.

5. The fuse clip of claim 1 wherein said spring member is a single piece convex member having corresponding securement means at the opposite ends, means interconnecting said securement means to said support wall and including means to permit deflection of said single spring member in response to insertion of a fuse blade between said contact surface and said spring member.

6. The fuse clip of claim 5 wherein said spring and said contact wall locate the fuse blade with an insertion angle substantially less than forty-five degrees.

7. The fuse clip of claim 5 wherein said spring attachment means includes coplanar slot means in the opposite ends of said support wall and said spring member includes flat planar end projections located to fit within said slots.

8. The fuse clip of claim 7 wherein at least one of said slots projects outwardly of the planar end in the unstressed state of said spring member whereby deflection of said spring member is accommodated by the movement of the free end of the spring member.

9. A contact apparatus for receiving and retaining a flat contact blade comprising, a lead connector including a terminal member having a lead connecting means and a contact blade-engaging wall having an extent and configuration substantially corresponding to that of the contact blade and being engaged by the contact blade in the operative state adapted for current interchange engagement with a contact blade and having a spring support wall located in spaced opposed and generally parallel relation to said contact blade-engaging wall, and a curved compression spring means secured by means at the opposite ends to said support wall and curving inwardly from the opposite ends of said blade and said support wall to an outermost radius location between the support wall and the contact blade-engaging wall and establishing a horizontal deflection force in excess of the vertical insertion force to resiliently engage the contact blade and hold the contact blade in firm contact with the contact blade-engaging wall.

10. The contact apparatus of claim 9 wherein said spring has an unstressed position defining a gap with said support wall substantially less than the thickness of the contact blade.

11. The contact apparatus of claim 9 wherein said blade-engaging wall and said contact are integral with said terminal means, said curved compression spring being a separate convex member having opposite outer edge portions secured to said support wall.

12. The contact apparatus of claim 9 wherein said blade-engaging wall and said support wall are integral with said terminal block, said spring including a pair of separate curved spring members oriented to define a curved beam spring and each spring member having an outer end integral with the support wall and extending inwardly toward each other, said spring members having inner ends spaced from each other.

13. A fuse clip apparatus for interconnecting of a blade-type cartridge fuse into circuit, comprising a terminal connector having a lead receiving means for interconnection to a circuit lead, said terminal connector including a pair of generally parallel walls defining a blade receiving slot between a contact wall and a support wall for receiving of a fuse blade of a blade-type cartridge fuse, said walls being spaced from each other by a distance in excess of the thickness of the fuse blade, a separator curved beam spring having a convex configuration and having the opposite ends thereof formed with flat coplanar ends, suupport wall having spaced slots to received said planar ends and locating the central portion of the spring in close spaced relation to said contact wall, said contact wall being spaced from said central portion of the curved beam spring and defining a space significantly less than the thickness of the fuse blade whereby upon insertion of the blade the beam spring is deflected to establish a holding force on the contact blade of a predetermined minimal level.

14. A fuse clip apparatus for interconnecting of a blade-type cartridge fuse into circuit, comprising a terminal connector having a lead receiving means for interconnection to a circuit lead, said terminal connector including a pair of spaced substantially generally parallel walls defining a blade receiving slot between a contact wall and a support wall with receiving of a fuse blade of a blade-type cartridge fuse, said walls being spaced from each other by a distance in excess of the thickness of the fuse blade, a curved beam spring integrally connected to said spaced support wall, said beam spring having opposing spring members with spaced ends in close spaced relation to said contact wall to define a gap therebetween, said gap between said contact wall and said spaced ends of the curved beam spring being significantly less than the thickness of the fuse blade whereby upon insertion of the blade the spring members of the beam spring are deflected to establish a holding force on the contact blade of a predetermined minimal level through the face of the engaged blade, the innermost of said spring members having an outer chamfered edge to define a tapered opening to receive the contact blade.

* * * * *